United States Patent [19]

Dellepiane et al.

[11] 4,256,291

[45] Mar. 17, 1981

[54] THREE-POSITIONS SLIDING GATE VALVE

[76] Inventors: Enrico Dellepiane, Via Dassori 29/20; Roberto Ricci, Via A.Boito 17/8; Giovanni Timossi, Via M.Gallino 17c/13, all of Genoa, Italy

[21] Appl. No.: 87,520

[22] Filed: Oct. 23, 1979

[30] Foreign Application Priority Data

Oct. 25, 1978 [IT] Italy ..... 12838 A/78

[51] Int. Cl.[3] ..... C21C 5/48

[52] U.S. Cl. ..... 266/272; 75/60

[58] Field of Search ..... 266/272; 75/60

[56] References Cited

U.S. PATENT DOCUMENTS 3,436,023 4/1969 Thalmann ..... 266/272

3,581,948 1/1971 Detalle ..... 266/272

*Primary Examiner*—P. D. Rosenberg

*Attorney, Agent, or Firm*—Robert E. Burns; Emmanuel J. Lobato; Bruce L. Adams

[57] ABSTRACT

The present invention has for its object a discharge gate for a container holding liquid metal, comprising two refractory members which are in face-to-face contact and are slidable one with respect to the other to open and close the gate, each of the members having a central aperture, which apertures are in register when the gate is open, and the gate being arranged such that the members can be moved with respect to one another in two, opposite directions away from the open position, for closing the gate, the gate thereby having two, different closed positions.

6 Claims, 4 Drawing Figures

THREE-POSITIONS SLIDING GATE VALVE

BACKGROUND OF THE INVENTION

Sliding discharge gate in conceptions have been known in their general principles for several decades, but in recent years they have progressively begun to substitute rod-type gates.

The principal advantages of sliding discharge gates with respect to rod-type gates consists essentially in the fact that the refractories which form the obturator last longer, as well as the fact that they can be exchanged from outside the ladle without waiting to cool the ladle to allow access of workmen to its interior. However, also in sliding discharge gates of known type there are some inconveniences:

First of all, it is not always easy to replace the refractory elements which must attend to the discharger sealing.

Secondly, said refractory material elements may break on account of the thermal variations which they undergo.

Thirdly, it is not easy to control the relative position of the sliding discharge gate during its operations.

Finally, it happens in known devices that the discharge gate opening and closing movement causes irregular wear to the various parts of refractory material elements, so that said elements must be replaced after comparatively short operation periods.

OBJECT OF THE INVENTION

The invention has for its object an improved sliding discharge gate, characterised in that it has one opening position and two closing positions, so as to obtain uniform wear of the refractory material elements, and hence a longer life of same.

DESCRIPTION OF A PREFERRED EMBODIMENT

Figure 1:
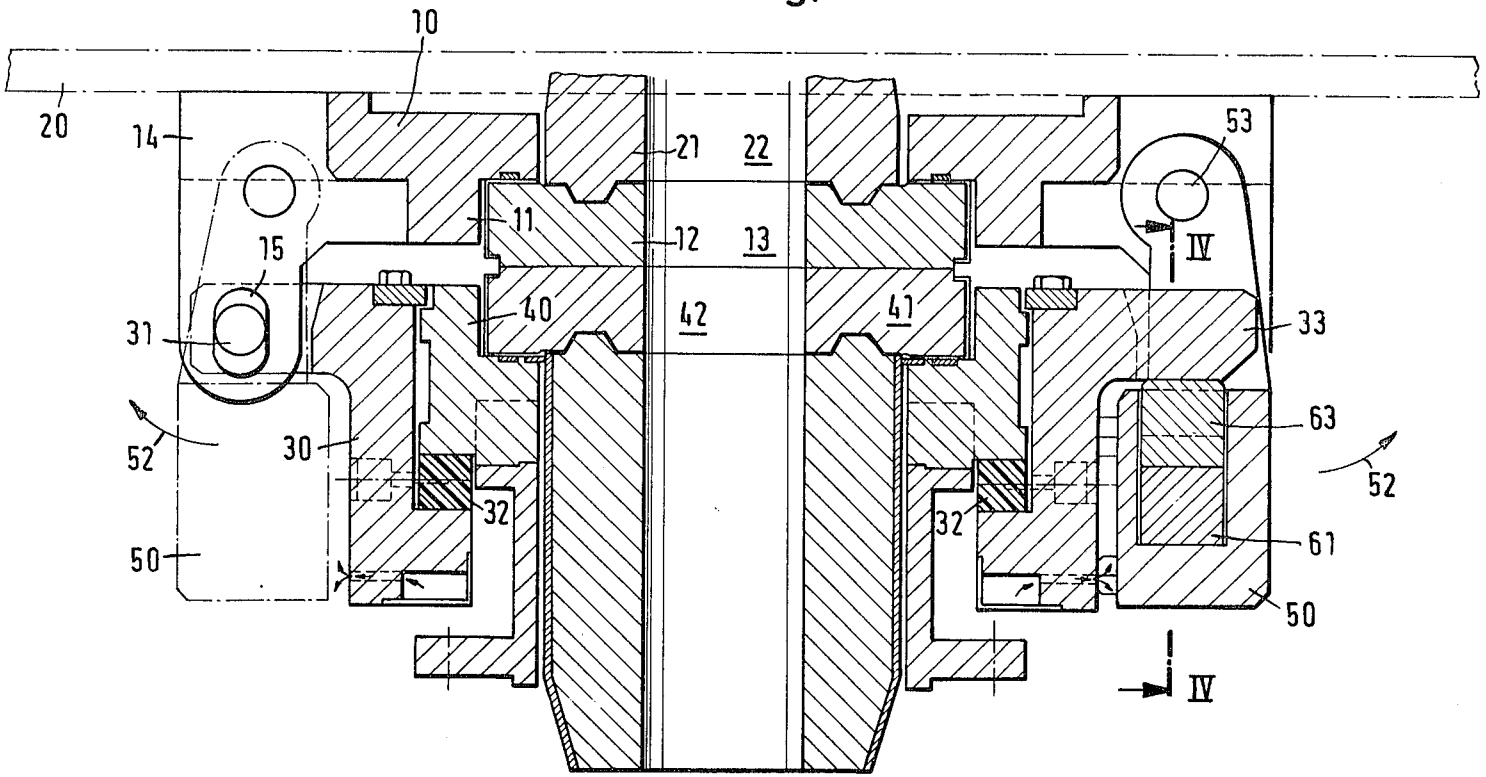
FIG. 1 is a transverse section of the sliding discharge gate according to the invention, i.e. a section perpendicular to the direction of movement of the obturator.

With particular reference to the Figures listed above, in a way known per se, the sliding discharge gate comprises a fixed, upper metallic plate 10 fixed to the base 20 of the ladle and provided with a central aperture which receives the lower end of a refractory sleeve 21 which tapers in a upwards direction in such a manner that it can be exchanged from outside the ladle.

There is a rectangular projection 11 on the lower face of the upper fixed plate 10, defining a cuboidal space in which is received a fixed, upper refractory brick 12 provided with a central aperture 13 registering with the aperture 22 in the sleeve 21. Four lugs 14 are provided at the four corners of the upper, fixed plate 10, projecting downwards, with the lower parts of the lugs 14 providing vertically-elongated eyes 15 suitable for receiving, with vertical play, pins 31 of a lower support plate 30 whose vertical position can be adjusted in the way described below but which is fixed to the upper, fixed plate 10 in respect of movements in the horizontal plane.

Thus, the lower support plate 30 is suspended from the upper fixed plate 10 by means of the lugs 14.

The lower support plate 30 is provided, as can be seen in FIG. 1, with sliding guides 32 for longitudinal edges of an intermediate sliding plate 40 whose upper face provides a cuboidal seat for an apertured refractory brick 41 which can slide longitudinally together with the plate 40. The brick 41 has an aperture 42 in a position which is central both longitudinally and traversely and which, when it registers with the aperture 13, determines the open position of the fate. When said aperture 42 is not in register with the aperture 13, the gate is in a closed position and the seal is formed by the correct contact of the facing surfaces of the two refractory bricks 12 and 41.

For this purpose, the lower support plate 30 is provided with a longitudinal flange 33 below which, according to a previous invention of the same Applicant, run wedges 61,63 which allow the support plate 30 to be raised if the facing surfaces of the two bricks 12 and 41 are not perfectly coplanar and in contact with one another. In such a position, which is the position illustrated in FIG. 1, the pin 31 received in the eyes 15 no longer support the lower support plate 30, but said wedges do so.

These latter are in turn supported by U-shaped duides 50 which are rotatably supported by pivots 53 fixed on the upper plate 10, which permit the U-shaped guides 50 to swing outwards in accordance with the direction indicated by the arrows 52, when said U-shaped guides are swung outwards to allow the gate to be dismounted, the support plate 30 is once again supported directly by means of the pins 31.

Figure 2:
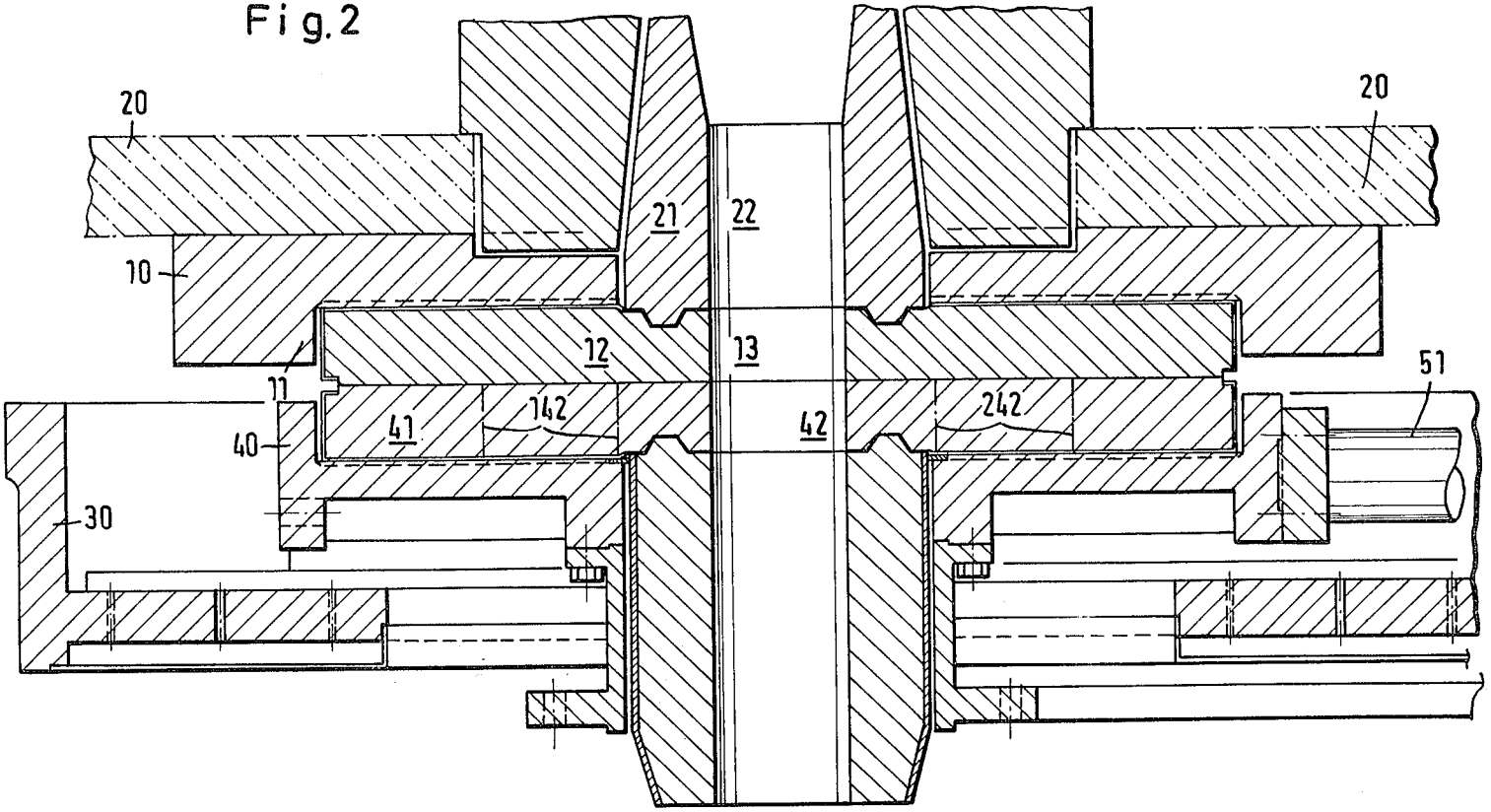
FIG. 2 is a vertical longitudinal section of the same gate, i.e. a vertical section parallel to the direction of movement of the obturator; it will be noted that this Figure shows a partial section and does not include the means for actuating the obturator, which are shown in the following FIG. 3 which forms the natural extension to the right of FIG. 2.

Because, according to the invention, the aperture 42 in the refractory brick 41 is in a central position, the seal of the sliding discharge gate can be obtained whether displacing the sliding plate 40 towards the left, as seen in FIG. 2, until the aperture 42 in the refractory brick 41 occupies the position 142 indicated by the - dot lines, or towards the right until the aperture 42 occupies the position 242 also indicated with-dot lines in FIG. 2.

In consequence, both the left-hand side upper surface of the brick 41 and the right-hand side surface of the same are used as sealing surfaces.

Figure 3:
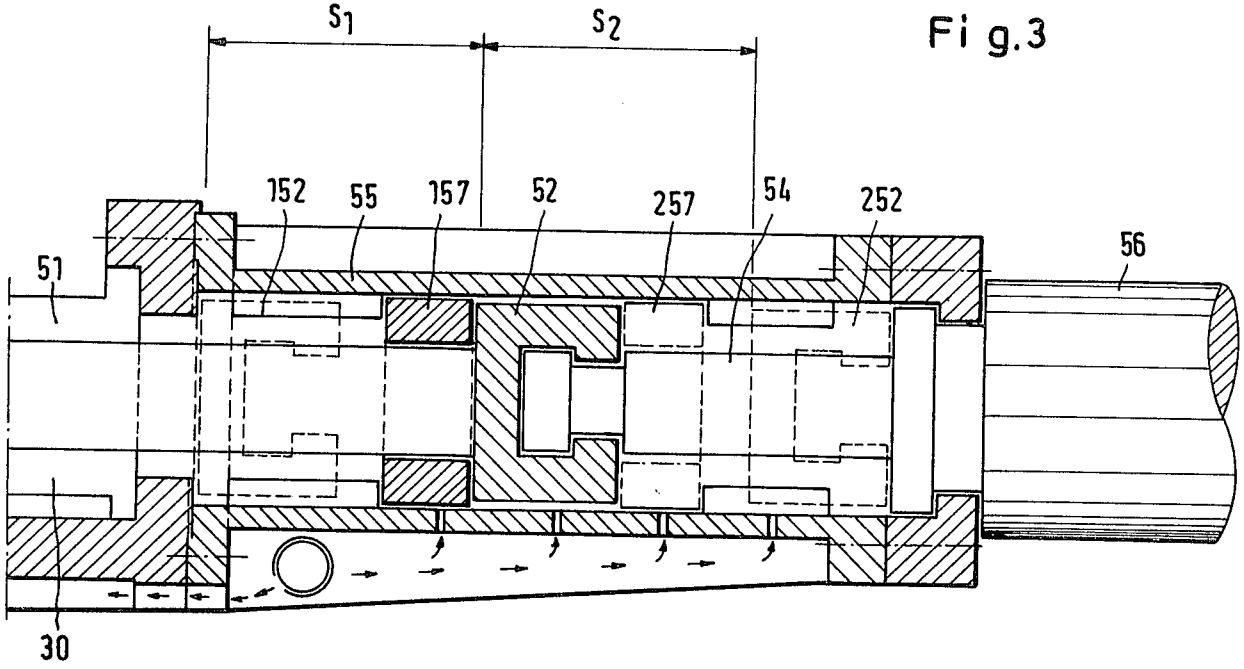

In order to move the sliding plate 30 and the brick 41 which is fixed thereto, one uses an actuating rod 51 whose end, see FIG. 3, has a connection piece 52 in which is fixed the end of a piston rod 54 of the ram 56.

The connection piece 52 is guided in a guide sleeve 55 fixed to the support plate 30 and whose end also supports the ram 56.

In FIG. 3, the connection piece 52 is in a position corresponding to the position 42 of the aperture in the brick 41; hence, when the connection piece 42 occupies the position illustrated in FIG. 3, the discharge gate is open. In order to move the discharge gate into the closed position in which the aperture 42 in the brick 41 occupies the position 142, it is necessary to move the connection piece 52 into the position 152 by means of the double acting ram 56; correspondingly, in order to move the aperture in the refractory brick 41 into the closed position 242, it is necessary to move the connection piece 52 into the position 252.

It is evident that if one wants to use the right-hand portion of the upper face of the brick 41 as the sealing surface, the aperture in the brick 42 must be moved from the position 42 into the position 142 and vice versa; correspondingly the connecting piece will be moved alternatively between the positions 52 and 152.

If one instead wants to use the left portion of the upper face of the brick 41 as sealing surface, the connection piece will be moved alternatively between the positions 52 and 252.

Correspondingly the aperture in the brick will be moved between the positions 42 and 242.

In the two cases the movement of the connection piece will be the same amount but in different directions as indicated by S1 and S2 in FIG. 3.

The extreme left-hand side of the movement S1 is defined by suitable shoulders on the guide sleeve 55; the same occurs for the extreme right of the movement S2. On the other hand, in order to find the extreme right-hand or the extreme left-hand, of the movement S1 or S2, according to the invention, an abutment fork is provided, insertable transversely into the sleeve 45 alternatively in the position 157 and 257.

Such an abutment fork is insertable laterally through suitable openings provided in the walls of the guide sleeve 55.

In such a manner, it is possible to double the life of the refractory bricks and hence the interval between dismantling the sliding discharge gate and dismantling in the next time.

Figure 4:
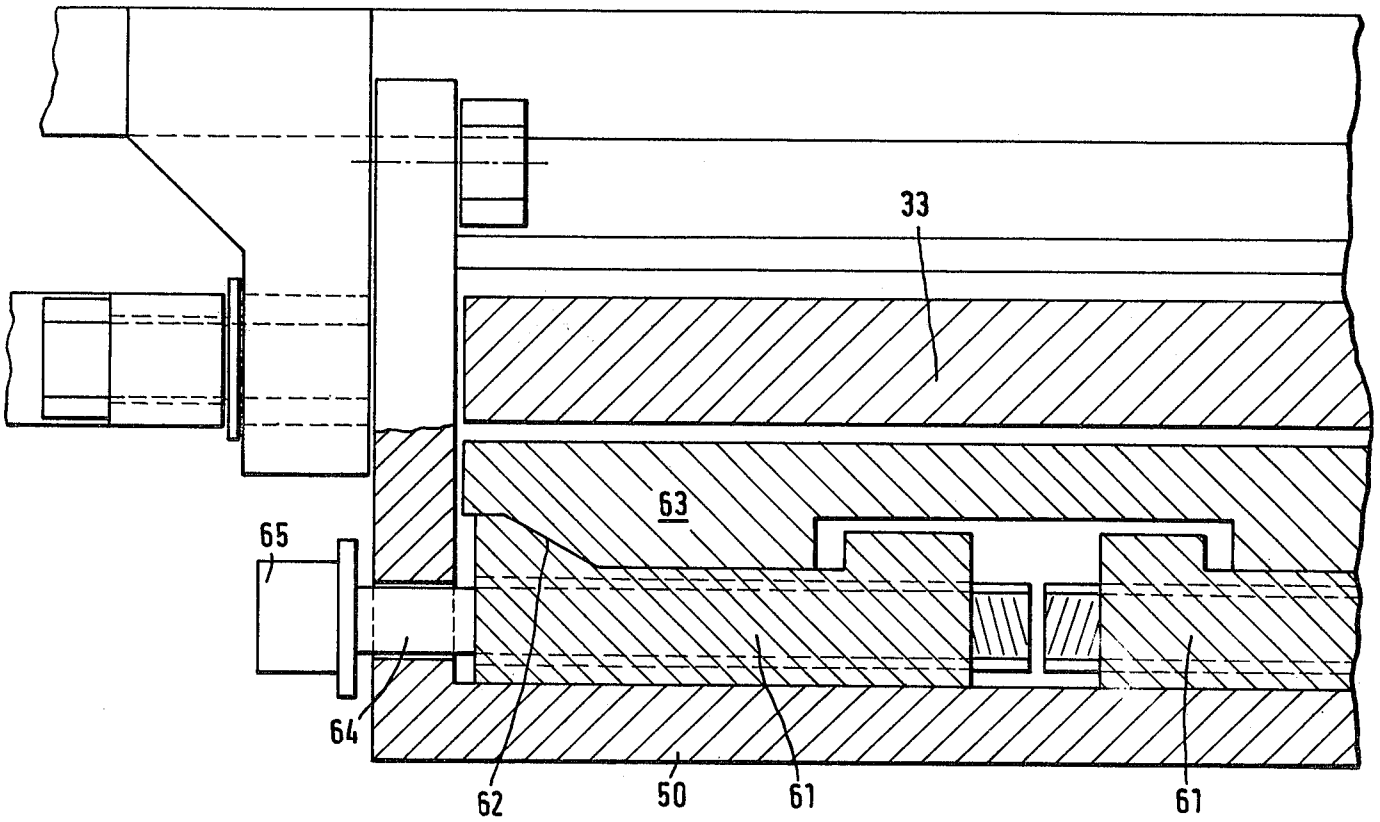
FIG. 4 is a section along the plane IV—IV of FIG. 1.

With particular reference to FIG. 4, this Figure shows a particularly useful variant of the wedges for the correct height position of the support plate 30.

According to the invention, two wedges 61 are symmetrically positioned in each of the U-shaped guides 50 in contact with the bottom of the guide, with the bottoms of the wedges horizontal and the upper faces 62 inclined in opposite directions. On said inclined faces 62 rest the opposed and inclined faces of an upper double wedge 63 whose planar upper face supports the flange 33 of the support plate 30. The two longer wedges 61 approach one another and move away from one another at the same time because of a single threaded spindle 64 actuated by a control head 65; the said spindle is subdivided in two portions one of which is left-handed and the other right-handed. In this way, when the spindle is rotated in one sense, the two lower wedges 61 approach one another and the upper double wedge is raised; when said spindle is rotated in the opposite sense, the two lower wedges 61 move apart and the upper double wedge is lowered.

Although, for the sake of description, the present invention has been based on that described above and illustrated only by way of example with particular reference to the attached drawings, many modifications and variants can be introduced into the realization of the discovery, and if such modifications and variants must be all the same considered to be based on the claims which follow.

What we claim is:

1. Improved sliding discharge gate, of the type which comprises an upper, fixed plate firmly connected to the base of the ladle, a lower support plate supported, in such a way that its height can be adjusted, from the upper plate and an intermediate plate which is slidable by suitable actuating means, in which the upper, fixed plate and the slidable intermediate plate are apertured and are each connected to a respective apertured refractory brick, in which in addition said lower support plate provides a pair of guides on which the longitudinal edges of the intermediate slidable plate slide, characterised by the fact that the apertures in the two said apertured bricks are disposed in a position which is central both relative to their longitudinal direction and relative to their transverse direction, in such a way that, from an open position of the gate in which the apertures in the two bricks are in register, two symmetrical closed position can be reached.

2. Sliding discharge gate according to claim 1, characterised by the fact that, for moving the slidable intermediate plate, there is provided a double-acting ram which is fixed to the lower support plate and whose stroke is equal to double the closing movement or opening movement of the gate, suitable abutment means for limiting the stroke of the ram piston being provided in such a way that, at will, the piston can move between an intermediate position corresponding to the open position of the gate, and one of its end positions, which end positions correspond to the closed position of the gate.

3. Sliding discharge gate according to claim 1, characterised by the fact that the intermediate plate is moved by means of an actuating rod whose end is connected by means of a suitable connection piece to the ram piston rod, in which a suitable abutment means, preferably in the form of a fork, alternatively limits in one direction or the other, the movement of said connection piece and thus of the piston from its intermediate position towards one of its end positions.

4. Sliding discharge gate according to claim 3, characterised by the fact that said connection piece is movable inside a suitable guide sleeve supported by the lower support plate, suitable apertures being provided in the walls of said guide sleeve for inserting said abutment fork on one side or the other of the intermediate position of said connection piece.

5. Sliding discharge gate according to claim 1, characterised by the fact that, for the height regulation of the position of the lower support plate, two swingable angle pieces are provided, mounted on pivots fixed to the upper fixed plate, which angle pieces have wedge means for the height adjustment of the position of the lower support plate, in which said wedge means are provided, on each side of the gate, a pair of lower, symmetrically-disposed wedges with their surfaces inclined in opposite senses, controlled mutually to approach one another and move away from one another by means of a single adjustment screw which is threaded right-handed in its portion associated with the first wedge and left-handed in its portion associated with the second wedge; in which above this pair of lower wedge rest a single upper wedge provided all the same with two lower surfaces which are inclined in opposite sense.

6. Sliding discharge gate according to claim 1, characterised by the fact that the refractory brick which is fixed to the slidable lower plate has two pouring apertures which are symmetrically positioned relative to its longitudinal direction in such a way as to provide three locations for positioning the gate, of which two are end, open positions of the gate and one is an intermediate, closed position of the same.

* * * * *

UNITED STATES PATENT AND TRADEMARK OFFICE

CERTIFICATE OF CORRECTION

PATENT NO. : 4,256,291

DATED : March 17, 1981

INVENTOR(S) : Enrico Dellepiane, Roberto Ricci, Giovanni Timossi

It is certified that error appears in the above-identified patent and that said Letters Patent are hereby corrected as shown below:

On the Title page add the following:

-- [73] Assignee: SANAC Societa per Azioni Refrattari Argille e Caolini, Genoa, ITALY --.

Signed and Sealed this

*Eighteenth* Day of *May 1982*

[SEAL]

*Attest:*

GERALD J. MOSSINGHOFF

*Attesting Officer*

*Commissioner of Patents and Trademarks*